US006679513B1

(12) United States Patent
Emig et al.

(10) Patent No.: US 6,679,513 B1
(45) Date of Patent: Jan. 20, 2004

(54) ALPINE SKI

(76) Inventors: Uwe Emig, Gartenstrasse 29, D-69429 Waldbrunn (DE); Reinhold Geilsdörfer, Landsehrstrasse 35, D-74821 Mosbach (DE); Markus Gramlich, Brunnenstrasse 39, D-69429 Waldbrunn (DE)

( * ) Notice: Subject to any disclaimer, the term of this patent is extended or adjusted under 35 U.S.C. 154(b) by 0 days.

(21) Appl. No.: 09/926,374

(22) PCT Filed: Apr. 15, 2000

(86) PCT No.: PCT/DE00/01188

§ 371 (c)(1),
(2), (4) Date: Oct. 22, 2001

(87) PCT Pub. No.: WO00/62877

PCT Pub. Date: Oct. 26, 2000

(30) Foreign Application Priority Data

Apr. 21, 1999 (DE) ..... 199 17 992

(51) Int. Cl.[7] ..... A63C 5/07
(52) U.S. Cl. ..... 280/602; 280/610; 280/609
(58) Field of Search ..... 280/602, 601, 280/607, 608, 609, 610, 634, 11.12, 14.22, 14.21, 614, 611

(56) References Cited

U.S. PATENT DOCUMENTS

| | | | | | |
|---|---|---|---|---|---|
| 2,258,046 | A | * | 10/1941 | Clement | 280/602 |
| 2,377,504 | A | | 6/1945 | Lermont | |
| 2,539,224 | A | * | 1/1951 | Beerli | 280/602 |
| 3,260,532 | A | * | 7/1966 | Heuvel | 280/602 |
| 3,722,901 | A | * | 3/1973 | Koike | 280/610 |
| 4,565,386 | A | * | 1/1986 | Crainich | 280/602 |
| 5,393,086 | A | * | 2/1995 | Le Masson et al. | 280/602 |
| 6,237,932 | B1 | * | 5/2001 | Zanco et al. | 280/602 |
| 6,406,054 | B1 | * | 6/2002 | Huyghe | 280/610 |

FOREIGN PATENT DOCUMENTS

| | | | | |
|---|---|---|---|---|
| DE | 2259375 | | 6/1974 | |
| DE | 31 01 977 | A1 | 11/1981 | |
| DE | 3223413 | A1 * | 1/1983 | A63C/05/04 |
| DE | 36 19 118 | A1 | 12/1987 | |
| FR | 2505193 | | 11/1982 | |
| FR | 2660385 | | 10/1991 | |
| FR | 2698794 | | 6/1994 | |

* cited by examiner

*Primary Examiner*—Brian L. Johnson
*Assistant Examiner*—Hau Phan
(74) *Attorney, Agent, or Firm*—Arent Fox Kintner Plotkin Kahn

(57) ABSTRACT

In an alpine ski (1) comprising a body (2) which is composed of several elements and has on its underside a gliding surface (3) and on its upper side (7) a binding mounting area (8), and includes at least one upper chord element (4) subjected primarily to pressure loads and at least one lower chord element (5) subjected to tensile loads, the upper chord element (4) has in the middle region of the ski the shape of a flat, upwardly curved arc (6) extending in the longitudinal direction of the ski and spanning the lower chord element (5). The arc (6) of the upper chord element (4) is adapted to deflect in the direction of the lower chord element (5) in dependence upon the load exerted by the binding and is supported in the end regions of the ski in such a way that a displacement of the ends of the upper chord element (5) resulting from the deflection of the arc (6) increases the load carrying share of the end regions of the ski.

47 Claims, 3 Drawing Sheets

ALPINE SKI

BACKGROUND OF THE INVENTION

This invention relates to an alpine ski comprising a body which is composed of several elements and has on its underside a gliding surface and on its upper side a binding mounting area, and includes at least one upper chord element subjected primarily to pressure loads and at least one lower chord element subjected to tensile loads.

In an alpine ski of the type referred to which is known from DE 31 01 977 A1, the upper and the lower chord are each formed of at least two layers of different material and connected with each other by way of a core elastic in shear. In order to vary the bias or the surface pressure distribution in dependence upon the ambient temperature in conformity with the requirements, the layers in the upper and lower chord are arranged asymmetrically to the longitudinal center plane of the ski as regards their successive sequence and thickness used, and the thickness of layers having a large coefficient of linear expansion in the upper chord is greater than in the lower chord, while the thickness of layers with a smaller coefficient of linear expansion in the upper chord is smaller than in the lower chord. Regardless of the variations of surface pressure distribution due to temperature, in this known ski the surface pressure in the middle region of the ski is significantly greater than in the ski's two end regions.

SUMMARY/OBJECT OF THE INVENTION

It is an object of the present invention to provide an alpine ski of the type initially referred to, which permits achieving a more uniform surface pressure distribution over the ski's gliding surface.

According to the present invention, this object is accomplished in that in the ski's middle region the upper chord element is shaped in the manner of a flat, upwardly curved arc extending in the longitudinal direction of the ski and spanning the lower chord element, and the arc of the upper chord element is adapted to deflect in the direction of the lower chord element in dependence upon the load exerted by the binding, and the upper chord element is supported in the end regions of the ski in such a way that a displacement of the ends of the upper chord element resulting from the deflection of the arc increases the load carrying share of the end regions of the ski.

The alpine ski of the present invention permits achieving a uniform pressure distribution over the full length of the ski's gliding surface, which depends on the respective load to a reduced degree, and a dynamic balance of bumps. This results in a maximum possible contact length of the ski edges, in addition to considerably improving both the tracking stability and the response to steering impulses of the skier. Another advantage is that impact loads emanating from the slope can be effectively damped by the bending elasticity of the upper chord element.

The deflection of the arched upper chord element is achievable by the provision of a cavity in the interior of the ski underneath the arc, the amplitude of deflection being limitable to a maximum value by suitably dimensioning the height of the cavity. According to a further proposal of the invention it is possible to substitute for the cavity a core of an elastic and/or elastically compressible material which is arranged between the arc of the upper chord element and the underlying lower chord element. In this arrangement the deflection and the vibrational behavior of the upper chord element can be influenced by the deformation resistance of the elastic or elastically compressible material. Furthermore, to influence the vibrational behavior the upper chord element can be arranged to take support on the lower chord element in longitudinal direction through friction elements and/or damping elements of an elastomeric material.

For force application the upper chord element has in the binding area preferably devices for attachment of the binding components. In a possible configuration the upper chord element has in the binding mounting area a plate bounding the ski upper side or embedded therein, to which plate the binding components are securable.

The alpine ski of the present invention may comprise one upper chord element and one lower chord element. However, it may also be advantageous to arrange in the ski body several upper chord elements and/or lower chord elements in juxtaposed relation to each other. An advantageous embodiment provides for the lower chord element to be made of a thin-walled strip of sheet metal, fiber material or fabric of high tensile strength. Preferably, the upper chord element may be composed of one or several rods or tubes or, alternatively, plate-shaped elements which are made of a pressure-resistant material, for example, metal, fiber-reinforced plastics, wood or similar material and which, owing to their shape and, if applicable, their embedding in the ski body, are sufficiently safe against buckling.

The upper chord element and the lower chord element preferably extend over the full length of the ski's gliding surface. In this arrangement the upper chord element may be arranged above the lower chord element over the entire length. In an advantageous configuration of the invention it is envisaged that the upper chord element crosses the lower chord element in one of the two end regions of the ski, subsequently continuing beneath the lower chord element. Still further, provision can be made for the upper chord element to cross the lower chord element twice in an end region of the ski, so that the upper chord element extends above the lower chord element in the middle of the ski and in the outer end region, while extending beneath the lower chord element in the area in-between. In this configuration the lower chord element or the upper chord element may have a respective cutout at the crossings through which the other element is passed.

Preferably the upper chord element and the lower chord element are fixedly connected with each other only at their ends. In the zone therebetween, the elements are carried in the ski body's material surrounding them. Sections of the elements may also be arranged on the ski body so as to be exposed, that is, visible and accessible from the outside. According to the present invention the upper chord element is guided in the ski body so as to be able to execute a longitudinal movement, though small, relative to the ski body.

The ski body material surrounding the elements is preferably a filler of low density, for example, a foamed plastics material, a fiber material or a fabric referred to as spacer fabric. According to the present invention the ski body may also include a box of mechanical resistance in which the elements surrounded by filler material are arranged.

BRIEF DESCRIPTION OF THE DRAWINGS

Embodiments of the present invention will be described in more detail in the following with reference to the accompanying drawings. In the drawings.

DETAILED DESCRIPTION

Figure 1:
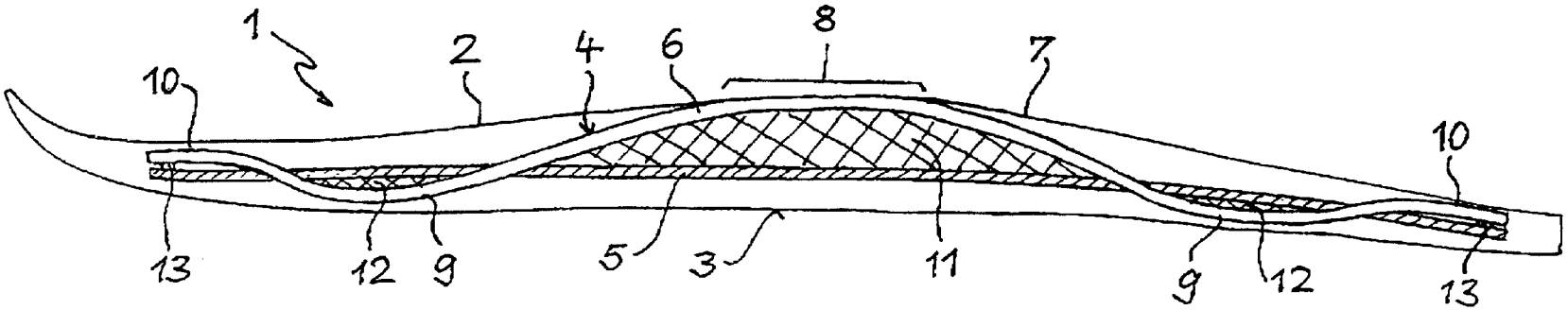
FIG. 1 is a schematic side view of an alpine ski illustrating a first embodiment of the present invention.
Figure 2:
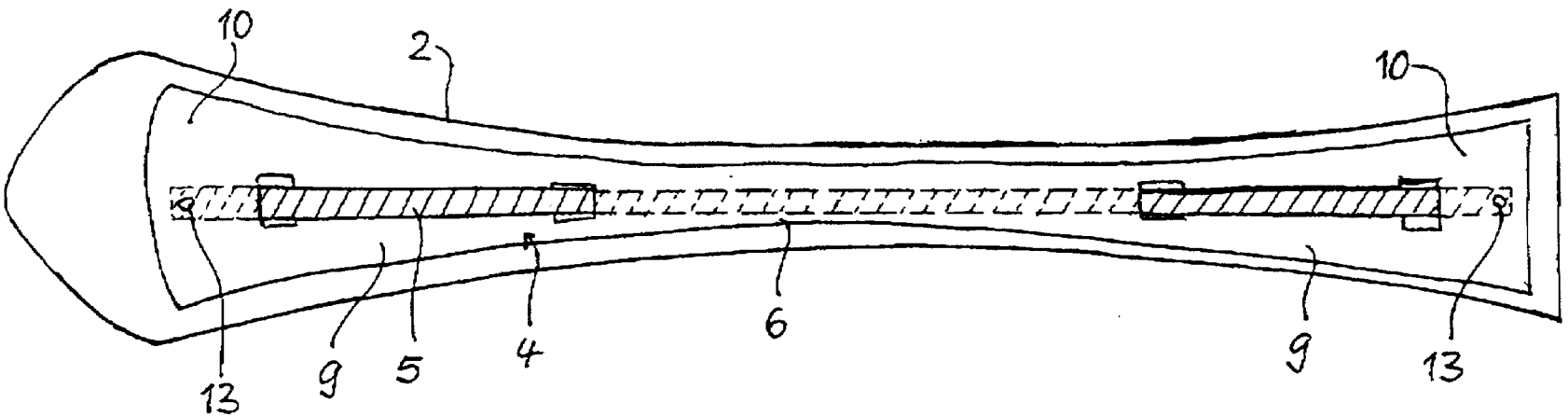
FIG. 2 is a schematic top view of the alpine ski of FIG. 1.

The alpine ski 1 illustrated in FIGS. 1 and 2 is comprised of a body 2 whose underside forms a gliding surface 3. Arranged in the body 2 in superposed position are an upper chord element 4 and a lower chord element 5.

The upper chord element 4 is comprised of an elongate strip of rectangular cross-section, with the width of the cross-section increasing progressively with the width of the body 2 from the middle of the ski to the ski ends. The strip may be made of metal, plastics, a fiber composite material or several layers of wood glued together. The thickness of the strip and the material selected for its manufacture are matched so as to enable pressure forces occurring in the ski longitudinal direction to be taken up. The middle section of the upper chord element 4 forms an upwardly curved arc 6 extending in the ski longitudinal direction, its central portion providing a mounting area 8 for the ski binding in the upper side 7 of the body 2. The upwardly curved arc 6 merges at either end into two smaller downwardly curved arcs 9 which, towards the front and rear end of the ski, merge with a respective end piece 10 extending in the ski longitudinal direction.

The lower chord element 5 extends beneath the arc 6 in a chordal direction, passing, in the transition regions between the arc 6 and the arc 9, through openings in the upper chord element 4 to continue on the upper chord element's upper side, and passing, in the transition regions between the arc 9 and the end piece 10, through further openings in the upper chord element 4 to continue on the underside of the upper chord element 4. The lower chord element 5 has its ends fixedly connected to the ends of the upper chord element 4 by means of fasteners 13. The lower chord element 5 is a web material resistant to tensile stress, being fabricated, for example, from a strip of metal, a wire rope or a fiber composite material.

Arranged beneath the arc 6 between it and the lower chord element 5 is a filler 11 made of an elastic and/or elastically compressible material. The filler 11 may be composed of several layers of material varying in elasticity or compressibility in order to obtain a non-linear increase in the deformation resistance. Between the arc 9 and the lower chord element 5 provision is made for fillers 12 which maintain a defined distance between the arc 9 and the element 5 and may be constructed as friction or damping elements. For example, the fillers 12 may be made of an elastomeric material and connected with the elements 4, 5 by thrust-transmitting processes such as adhesive bonding.

The body 2 surrounds the elements 4, 5 with a light filler material, for example, foamed plastics or a fiber composite material, and the surface of the body 2 is reinforced in conventional manner by hard layers made of plastics and/or metal.

The described configuration of the alpine ski 1 results in a load-dependent variation of the inherent rigidity of the ski in such manner that a more uniform pressure distribution is achieved over the entire length of the gliding surface 3 than is accomplishable with conventional ski designs. Furthermore bumps can be better accommodated because a deformation of one end region of the ski is transmitted to the other end region of the ski in opposite direction, thereby resulting in a permanent balance of compressive and tensile loads.

Figure 3:
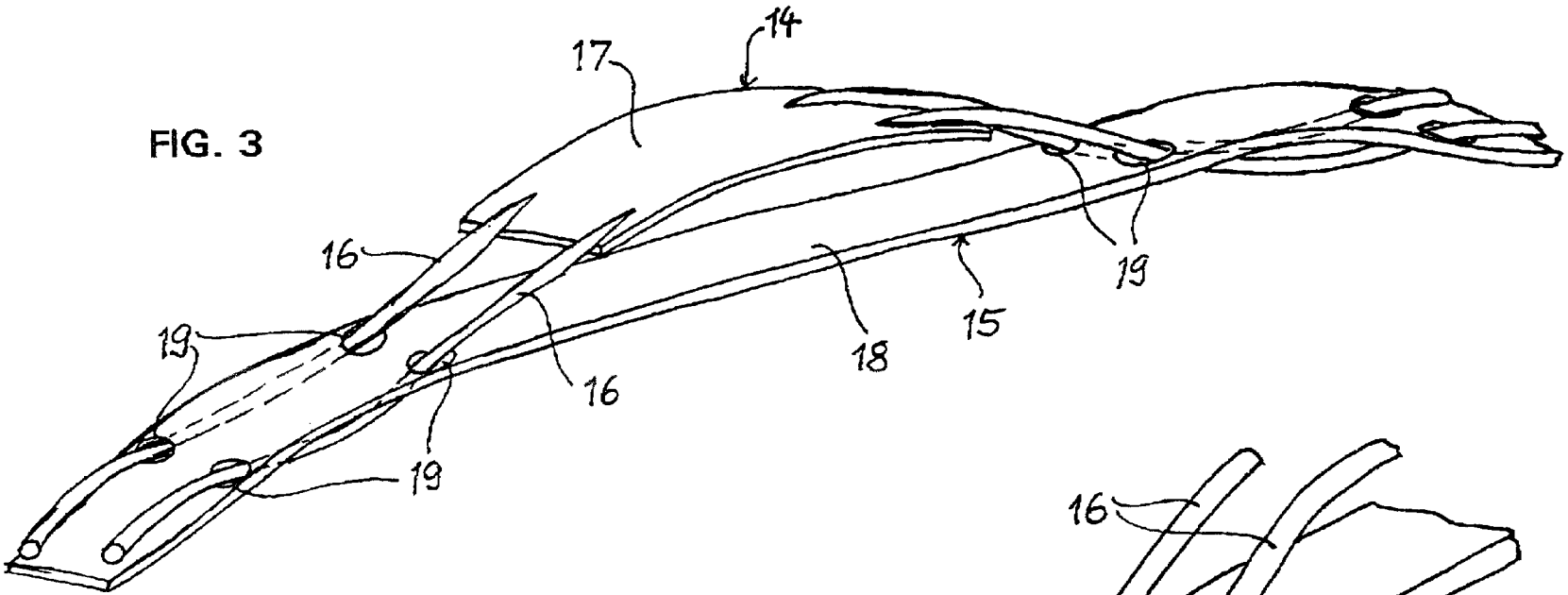
FIG. 3 is a perspective view of a second embodiment of the upper and lower chord elements.

FIG. 3 shows another embodiment of an upper chord element 14 and a lower chord element 15 which may be substituted for the elements 4, 5 in the alpine ski 1. The upper chord element 14 is comprised of two thrust rods 16 arranged in juxtaposed relation and formed integral with a bent plate 17 in the binding mounting area. The lower chord element 15 is formed by a sheet metal strip 18 having respective openings 19 at the crossing points between the thrust rods 16 and the lower chord element 15, through which openings the thrust rods 16 are passed.

Figure 4:
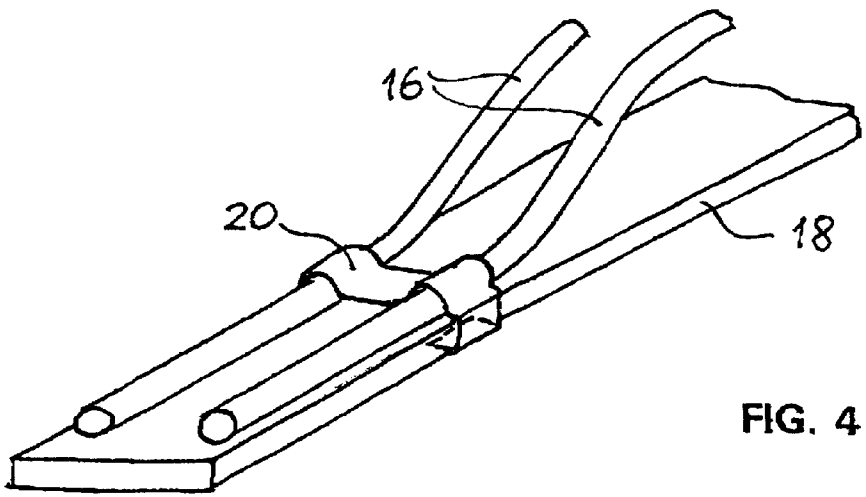
FIG. 4 is view of a modification of the end region of the lower chord element of FIG. 3.

FIG. 4 shows a modification of the embodiment of FIG. 3 in which the upper chord element 14, rather than crossing the lower chord element 15, is arranged above the lower chord element 15 over its entire length. In this modification the thrust rods 16 are held on the upper side of the sheet metal strip 18 by a respective clip 20 at either end of the bent center section of the upper chord element 14, extending from there towards their respective fastening end on the upper side of the sheet metal strip.

Figure 5:
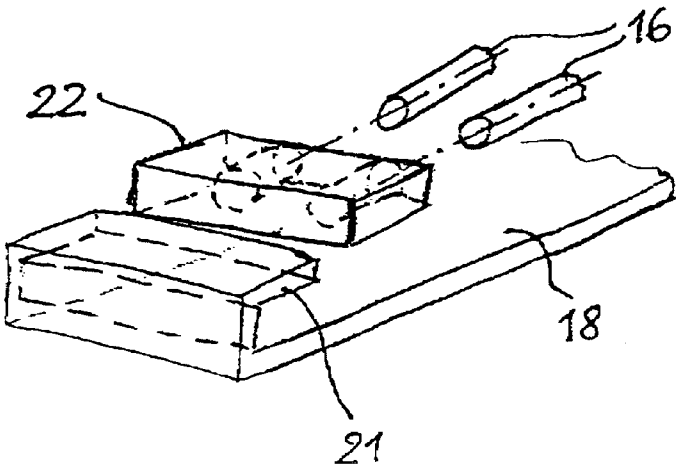
FIG. 5 is a perspective view of an embodiment of the connection between the ends of upper and lower chord element of the embodiments of FIGS. 3 and 4.

FIG. 5 shows a possibility for fastening the ends of the thrust rods 16 to the ends of the sheet metal strip 18 in the embodiments illustrated in FIGS. 3 and 4. The sheet metal strip 18 has its end bent twice at right angles, whereby a hook 21 is formed which receives a right parallelepipedal intermediate piece 22. The intermediate piece 22 has two parallel blind-end bores 23 adapted to receive the ends of the thrust rods 16. The intermediate piece 22 may take support on the hook 21 directly or via an elastic damping element.

Figure 6:
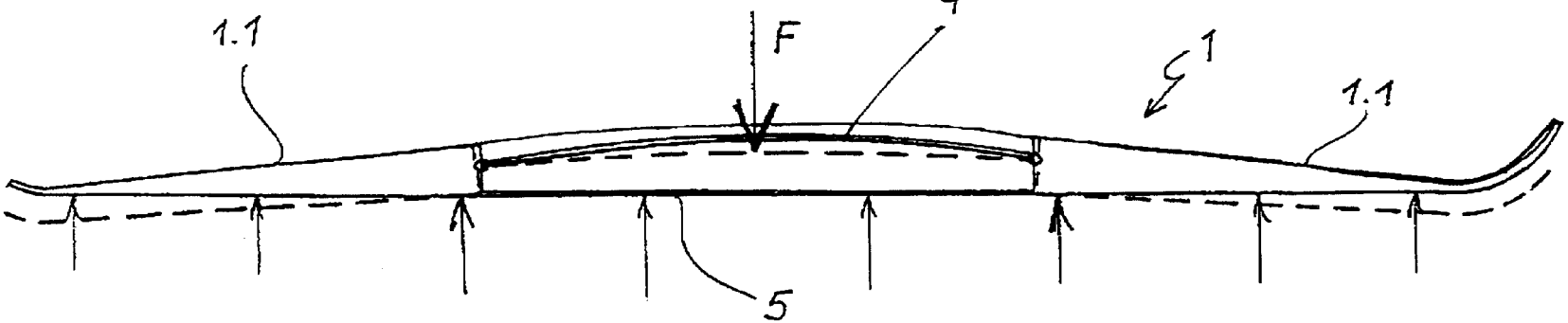
FIG. 6 shows the principle of operation of the alpine ski of the present invention.

FIG. 6 shows the mode of operation of the alpine ski 1 of the present invention. The lines drawn in full show the alpine ski 1 under low-load conditions. When the skier, in performing a weight shift, increases the load on the upper chord element 4 by force F, the upper chord element 4 will deflect, whereby its curvature diminishes and its ends are caused to move slightly away from each other in the longitudinal direction. This deformation of the upper chord element 4 propagates to the end regions 1.1 of the ski 1 which, being retained by the lower chord element 5, tend to deform in the sense of the dashed lines. The load-carrying share taken by the end regions 1.1 of the ski 1 increases correspondingly, hence resulting in a more uniform load distribution over the entire length of the ski.

What is claimed is:

1. An alpine ski comprising a body which is composed of several elements and has on an underside a gliding surface and on an upper side a binding mounting area, and includes at least one upper chord element subjected primarily to pressure loads and at least one lower chord element subjected to tensile loads, characterized in that at least a section of at least one of the upper chord element and lower chord element is arranged within the ski body, and in the ski's middle region the upper chord element (4) is shaped in the manner of an upwardly curved arc (6) extending in the longitudinal direction of the ski and spanning the lower chord element (5), and the arc (6) of the upper chord element (4) is adapted to deflect in the direction of the lower chord element (5) in dependence upon the load exerted by the binding, and the upper chord element (4) is supported in the end regions of the ski in such a way that a displacement of the ends of the upper chord element (5) resulting from the deflection of the arc (6) increases the load carrying share of the end regions of the ski.

2. The alpine ski as claimed in claim 1, characterized by the provision of a cavity in the interior of the ski underneath the arc (6).

3. The alpine ski as claimed in any one of the claims 1 or 2, characterized in that a filler (11) made of an elastic or elastically compressible material is arranged between the arc (6) of the upper chord element (4) and the underlying chord element (6).

4. The alpine ski as claimed in claim 1, characterized in that the upper chord element (4) takes support on the lower chord element (5) in longitudinal direction through friction elements or damping elements.

5. The alpine ski as claimed in claim 4, wherein at least one of the friction elements or damping elements is of an elastomeric material.

6. The alpine ski as claimed in claim 1, characterized in that the upper chord element (4) has in the binding area (8) devices for attachment of binding components.

7. The alpine ski as claimed in claim 1, characterized in that the upper chord element (6) has in the binding mounting area (8) a plate (17) bounding the ski upper side (7) or embedded therein, to which plate the binding components are securable.

8. The alpine ski as claimed in claim 1, characterized in that it comprises one single upper chord element (4) and one single lower chord element (5).

9. The alpine ski as claimed in claim 1, characterized in that several upper chord elements (4) or lower chord elements (5) are arranged in the ski body (2) in juxtaposed relation to each other.

10. The alpine ski as claimed in claim 1, characterized in that the lower chord element (5) is made of a thin-walled strip of sheet metal, fiber material or fabric of high tensile strength.

11. The alpine ski as claimed in claim 1, characterized in that the upper chord element (4) is composed of one of several rods or tubes or plate-shaped elements which are made of a pressure-resistance material.

12. The alpine ski as claimed in claim 11, wherein the pressure-resistance material is at least one of a metal, fiber-reinforced plastics or wood.

13. The alpine ski as claimed in claim 1, characterized in that the upper chord element (4) and the lower chord element (5) extend over the full length of the ski's gliding surface (3).

14. The alpine ski as claimed in claim 1, characterized in that the upper chord element (4) is arranged above the lower chord element (5) over the entire length of the lower chord element.

15. The alpine ski as claimed in claim 1, characterized in that the upper chord element (4) crosses the lower chord element (5) in one of the two end regions of the ski, subsequently continuing beneath the lower chord element (5).

16. The alpine ski as claimed in claim 1, characterized in that the upper chord element (4) crosses the lower chord element (5) twice in an end region of the ski, so that the upper chord element (4) extends above the lower chord element (5) in the middle of the ski and in the outer end region, while extending beneath the lower chord element (5) in the area in-between.

17. The alpine ski as claimed in claim 1, characterized in that the lower chord element (5) or the upper chord element (4) has a respective cutout at the crossings through which the other element (4 or 5) is passed.

18. The alpine ski as claimed in claim 1, characterized in that the upper chord element (4) and the lower chord element (5) are fixedly connected with each other only at their ends.

19. The alpine ski as claimed in claim 1, characterized in that the upper chord element (4) is carried and guided on the ski body (2) so as to be able to execute a longitudinal movement relative to the ski body (2).

20. The alpine ski as claimed in claim 1, characterized in that the material of the ski body (2) surrounding said elements (4, 5) is a filler of low density.

21. The alpine ski as claimed in claim 20, wherein the filler of low density is at least one of a foamed plastics material, a fiber material or a fabric referred to as a spacer fabric.

22. The alpine ski as claimed in claim 1, characterized in that the ski body (2) also includes a box of mechanical resistance in which said elements (4, 5) surrounded by filler material are arranged.

23. The alpine ski as claimed in any one of the claims 1 or 2, characterized in that a filler (11) made of an elastic and elastically compressible material is arranged between the arc (6) of the upper chord element (4) and the underlying chord element (6).

24. The alpine ski as claimed in claim 1, characterized in that the upper chord element (4) takes support on the lower chord element (5) in longitudinal direction through friction elements and damping elements.

25. The alpine ski as claimed in claim 22, wherein at least one of the friction elements and damping elements is of an elastomeric material.

26. The alpine ski as claimed in claim 1, characterized in that several upper chord elements (4) and lower chord elements (5) are arranged in the ski body (2) in juxtaposed relation to each other.

27. The alpine ski as claimed in claim 1, characterized in that the upper chord element (4) and the lower chord element (5) are movably connected through at least one clip.

28. An alpine ski comprising a body which is composed of several elements and has on an underside a gliding surface and on an upper side a binding mounting area, and includes at least one upper chord element subjected primarily to pressure loads and at least one lower chord element subjected to tensile loads, characterized in that at least a first section of at least one of the upper chord element and lower chord element is arranged within the ski body and at least a second section of at least one of the upper chord element and lower chord element is arranged outside the ski body, and in the ski's middle region the upper chord element (4) is shaped in the manner of an upwardly curved arc (6) extending in the longitudinal direction of the ski and spanning the lower chord element (5), and the arc (6) of the upper chord element (4) is adapted to deflect in the direction of the lower chord element (5) in dependence upon the load exerted by the binding, and the upper chord element (4) is supported in the end regions of the ski in such a way that a displacement of the ends of the upper chord element (5) resulting from the deflection of the arc (6) increases the load carrying share of the end regions of the ski.

29. The alpine ski as claimed in claim 28, characterized by the provision of a cavity in the interior of the ski underneath the arc (6).

30. The alpine ski as claimed in any one of the claims 28 or 29, characterized in that a filler (11) made of at least one of an elastic or elastically compressible material is arranged between the arc (6) of the upper chord element (4) and the underlying chord element (6).

31. The alpine ski as claimed in claim 28, characterized in that the upper chord element (4) takes support on the lower chord element (5) in longitudinal direction through at least one friction element or damping element.

32. The alpine ski as claimed in claim 28, characterized in that the upper chord element (4) has in the binding area (8) devices for attachment of binding components.

33. The alpine ski as claimed in claim 28, characterized in that the upper chord element (6) has in the binding mounting area (8) a plate (17) bounding the ski upper side (7) or embedded therein, to which plate the binding components are securable.

34. The alpine ski as claimed in claim 28, characterized in that it comprises one single upper chord element (4) and one single lower chord element (5).

35. The alpine ski as claimed in claim 28, characterized in that a plurality of upper chord elements (4) or lower chord elements (5) are arranged in the ski body (2) in juxtaposed relation to each other.

36. The alpine ski as claimed in claim 28, characterized in that the lower chord element (5) is made of a thin-walled strip of sheet metal, fiber material of fabric of high tensile strength.

37. The alpine ski as claimed in claim 28, characterized in that the upper chord element (4) is composed of one of several rods or tubes or plate-shaped elements which are made of a pressure-resistant material.

38. The alpine ski as claimed in claim 28, characterized in that the upper chord element (4) and the lower chord element (5) extend over the full length of the ski's gliding surface (3).

39. The alpine ski as claimed in claim 28, characterized in that the upper chord element (4) is arranged above the lower chord element (5) over the entire length of the lower chord element.

40. The alpine ski as claimed in claim 28, characterized in that the upper chord element (4) crosses the lower chord element (5) in one of the two end regions of the ski, subsequently continuing beneath the lower chord element (5).

41. The alpine ski as claimed in claim 28, characterized in that the upper chord element (4) crosses the lower chord element (5) twice in an end region of the ski, so that the upper chord element (4) extends above the lower chord element (5) in the middle of the ski and in the outer end region, while extending beneath the lower chord element (5) in the area in-between.

42. The alpine ski as claimed in claim 28, characterized in that the lower chord element (5) or the upper chord element (4) has a respective cutout at the crossings through which the other element (4 or 5) is passed.

43. The alpine ski as claimed in claim 28, characterized in that the upper chord element (4) and the lower chord element (5) are fixedly connected with each other only at their ends.

44. The alpine ski as claimed in claim 28, characterized in that the upper chord element (4) is carried and guided on the ski body (2) so as to be able to executed a longitudinal movement relative to the ski body (2).

45. The alpine ski as claimed in claim 28, characterized in that the material of the ski body (2) surrounding said elements (4, 5) is a filler of low density.

46. The alpine ski as claimed in claim 28, characterized in that the ski body (2) also includes a box of mechanical resistance in which said elements (4, 5) surrounded by filler material are arranged.

47. The alpine ski as claimed in claim 28, characterized in that the upper chord element (4) and the lower chord element (5) are movably connected through at least one clip.

* * * * *